US005616991A

United States Patent [19]

Casper et al.

[11] Patent Number: 5,616,991

[45] Date of Patent: Apr. 1, 1997

[54] FLAT PANEL DISPLAY IN WHICH LOW-VOLTAGE ROW AND COLUMN ADDRESS SIGNALS CONTROL A MUCH HIGHER PIXEL ACTIVATION VOLTAGE

[75] Inventors: Stephen L. Casper; Glen E. Hush; Thomas W. Voshell, all of Boise, Id.

[73] Assignee: Micron Technology, Inc., Boise, Id.

[21] Appl. No.: 530,562

[22] Filed: Sep. 19, 1995

Related U.S. Application Data

[63] Continuation of Ser. No. 209,579, Mar. 11, 1994, abandoned, which is a continuation-in-part of Ser. No. 11,927, Feb. 1, 1993, Pat. No. 5,357,172, which is a continuation-in-part of Ser. No. 864,702, Apr. 7, 1992, Pat. No. 5,210,472, which is a continuation-in-part of Ser. No. 458,853, Jun. 2, 1995, abandoned, which is a continuation of Ser. No. 138,535, Oct. 15, 1993, abandoned, which is a continuation-in-part of Ser. No. 77,181, Jun. 15, 1993, Pat. No. 5,410,218, which is a continuation-in-part of Ser. No. 11,927, Feb. 1, 1993, Pat. No. 5,357,172, which is a continuation-in-part of Ser. No. 864,702, Apr. 19, 1992, Pat. No. 5,210,472, which is a continuation-in-part of Ser. No. 311,971, Sep. 26, 1994, abandoned, which is a continuation of Ser. No. 60,111, May 11, 1993, abandoned, which is a continuation-in-part of Ser. No. 305,107, Sep. 13, 1994, abandoned, which is a continuation of Ser. No. 102,598, Aug. 5, 1993, abandoned, which is a continuation-in-part of Ser. No. 60,111, May 11, 1993, abandoned.

[51] Int. Cl.[6] ..... H05B 33/12; H05B 41/36; H05B 41/392

[52] U.S. Cl. ..... 315/167; 315/169.3; 315/210; 315/226; 315/260; 315/315; 315/DIG. 7

[58] Field of Search ..... 315/167, 169.1, 315/169.3, 169.4, 210, 226, 260, 315, 349, DIG. 7

[56] References Cited

U.S. PATENT DOCUMENTS

| | | | |
|---|---|---|---|
| 3,611,022 | 10/1971 | Galusha | 315/169.4 X |
| 4,348,616 | 9/1982 | Tanaka et al. | 315/315 X |
| 4,691,145 | 9/1987 | Satoh | 315/260 X |
| 4,857,799 | 8/1989 | Spindt et al. | 313/495 |
| 4,908,539 | 3/1990 | Meyer | 315/169.3 |
| 5,028,844 | 7/1991 | Sakaguchi et al. | 315/226 X |
| 5,036,317 | 7/1991 | Buzak | 340/783 |
| 5,103,144 | 4/1992 | Dunham | 315/366 |
| 5,153,483 | 10/1992 | Kishino et al. | 315/3 |
| 5,157,309 | 10/1992 | Parker et al. | 315/169.1 |
| 5,162,704 | 11/1992 | Kobori et al. | 315/349 |
| 5,210,472 | 5/1993 | Casper et al. | 315/349 |
| 5,212,426 | 5/1993 | Kane | 315/169.1 |
| 5,283,500 | 2/1994 | Kochanski | 315/58 |
| 5,313,140 | 5/1994 | Smith | 315/169.1 |
| 5,357,172 | 10/1994 | Lee et al. | 315/167 |
| 5,359,256 | 10/1994 | Gray | 313/169 |
| 5,387,844 | 2/1995 | Browning | 315/169.3 |
| 5,410,218 | 4/1995 | Hush | 315/169.1 |
| 5,459,480 | 10/1995 | Browning et al. | 345/75 |

*Primary Examiner*—David Mis

*Attorney, Agent, or Firm*—Angus C. Fox, III; Robert J. Stern

[57] ABSTRACT

This invention is directed to an improvement of a field emission display architecture in which low-voltage row and column address signals control a much higher pixel activation voltage. Instead of using a pair of series-coupled transistors in the emitter node grounding path as in the original architecture (one of which is gated by a column signal and the other of which is gated by a row signal), only a single transistor is utilized in the emitter node grounding path, thus eliminating an intermediate node between the two transistors that was responsible for unwanted emissions under certain operating conditions. In a preferred embodiment of the invention, a current regulating resistor is placed in the grounding path in series with the primary grounding transistor, with the resistor being directly coupled to ground. Additionally, for the preferred embodiment of the invention, the gate of the grounding transistor is coupled via a second field-effect transistor to either a row signal or a column signal. In the case where the gate of the first transistor is coupled to a row signal, the gate of the second transistor is coupled to a column signal. Likewise, where the gate of the first transistor is coupled to a column signal, the gate of the second transistor is coupled to a row signal. Numerous other equivalent circuits are possible, and several examples of such equivalent circuits are depicted in this disclosure.

5 Claims, 3 Drawing Sheets

FLAT PANEL DISPLAY IN WHICH LOW-VOLTAGE ROW AND COLUMN ADDRESS SIGNALS CONTROL A MUCH HIGHER PIXEL ACTIVATION VOLTAGE

This application is a continuation of application Ser. No. 08/209,579 filed Mar. 11, 1994, now abandoned, which application is a continuation-in-part of application Ser. No. 08/011,927 that was filed on Feb. 1, 1993, now U.S. Pat. No. 5,357,172, which in turn, is a continuation-in-part of application Ser. No. 07/864,702 that was filed on Apr. 7, 1992 and is now issued U.S. Pat. No. 5,210,472,which is a continuation-in-part of application Ser. No. 08/458,853 filed Jun. 2, 1995 by Lee et al.; abandoned which is a continuation of application Ser. No. 08/138,535 filed Oct. 15, 1993, now abandoned; which is a continuation-in-part of application Ser. No. 08/077,181 filed Jun. 15, 1993, now U.S. Pat. No. 5,410,218, and which is a continuation-in-part of application Ser. No. 08/011,927 filed Feb. 1, 1993, now U.S. Pat. No. 5,357,172, which is a continuation-in-part of application Ser. No. 07/864,702, filed Apr. 7, 1992, now U.S. Pat. No. 5,210,472. This application also is a continuation-in-part of copending application Ser. No. 08/311,971 filed Sept. 26, 1994, abandoned, by Hush et al., which is a continuation of application Ser. No. 08/060,111 filed May 11, 1993, now abandoned. This application also is a continuation-in-part of copending application Ser. No. 08/305,107 filed Sep. 13, 1994 by Hush et al., abandoned, which is a continuation of application Ser. No. 08/102,598 filed Aug. 5, 1993, now abandoned, which is a continuation-in-part of application Ser. No. 08/060,111 filed May 11, 1993, now abandoned.

FIELD OF THE INVENTION

This invention relates to flat panel displays and, more particularly, to effective current regulation in a matrix-addressable flat panel display in which low-voltage row and column address signals control a much higher pixel activation voltage. This invention not only permits the use of row and column signal voltages that are compatible with standard integrated circuit logic levels, but also provides regulated, low-current operation that extends cathode life expectancy and reduces power consumption requirements.

BACKGROUND OF THE INVENTION

For more than half a century, the cathode ray tube (CRT) has been the principal device for displaying visual information. Although CRTs have been endowed during that period with remarkable display characteristics in the areas of color, brightness, contrast and resolution, they have remained relatively bulky and power hungry. The advent of portable computers has created intense demand for displays which are lightweight, compact, and power efficient. Although liquid crystal displays are now used almost universally for laptop computers, contrast is poor in comparison to CRTs, only a limited range of viewing angles is possible, and in color versions, they consume power at rates which are incompatible with extended battery operation. In addition, color screens tend to be far more costly than CRTs of equal screen size.

As a result of the drawbacks of liquid crystal display technology, thin film field emission display technology has been receiving increasing attention by industry. Flat panel display utilizing such technology employ a matrix-addressable array of pointed, thin-film, cold field emission cathodes in combination with a phosphor-luminescent screen.

Somewhat analogous to a cathode ray tube, individual field emission structures are sometimes referred to as vacuum microelectronic triodes. The triode elements are a cathode (emitter tip), a grid (also referred to as the gate), and an anode (typically, the phosphor-coated element to which emitted electrons are directed).

Although the phenomenon of field emission was discovered in the 1950's, extensive research by many individuals, such as Charles A. Spindt of SRI International, has improved the technology to the extent that its prospects for use in the manufacture of inexpensive, low-power, high-resolution, high-contrast, full-color flat displays appear promising. However, much work remains to be done in order to successfully commercialize the technology.

There are a number of problems associated with contemporary matrix-addressable field-emission display designs. To date, such displays have been constructed such that a column signal activates a single conductive strip within the grid, while a row signal activates a conductive strip within the emitter base electrode. At the intersection of an activated column and an activated row, a grid-to-emitter voltage differential sufficient to induce field emission will exist, causing illumination of an associated phosphor on the phosphorescent screen. In FIG. 1, which is representative of such contemporary architecture, three grid (grid) strips 11A, 11B, and 11C orthogonally intersect a trio of emitter base electrode (row) strips 12A, 12B, and 12C. In this representation, each row-column intersection (the equivalent of a single pixel within the display) contains 16 field emission cathodes (also referred to herein as "emitters") 13. In reality, the number of emitter tips per pixel may vary greatly. The tip of each emitter tip is surrounded by a grid strip aperture 14. In order for field emission to occur, the voltage differential between a row conductor and a column conductor must be at least equal to a voltage which will provide acceptable field emission levels. Field emission intensity is highly dependent on several factors, the most important of which is the sharpness of the cathode emitter tip and the intensity of the electric field at the tip. Although a level of field emission suitable for the operation of flat panel displays has been achieved with emitter-to-grid voltages as low as 80 volts (and this figure is expected to decrease in the coming years due to improvements in emitter structure design and fabrication) emission voltages will probably remain far greater than 5 volts, which is the standard CMOS, NMOS, and TTL "1" level. Thus, if the field emission threshold voltage is at 80 volts, row and column lines will, most probably, be designed to switch between 0 and either +40 or −40 volts in order to provide an intersection voltage differential of 80 volts. Hence, it will be necessary to perform high-voltage switching as these row and column lines are activated. Not only is there a problem of building drivers to switch such high voltages, but there is also the problem of unnecessary power consumption because of the capacitive coupling of row and column lines. That is to say, the higher the voltage on these lines, the greater the power required to drive the display.

In addition to the problem of high-voltage switching, aperture displays suffer from low yield and low reliability due to the possibility of emitter-to-grid shorts. Such a short affects the voltage differential between the emitters and grid within the entire array, and may well render the entire array useless, either by consuming so much power that the supply is not able to maintain a voltage differential sufficient to induce field emission, or by actually generating so much heat that a portion of the array is actually destroyed.

A new field emission display architecture, which is the subject of U.S. Pat. No. 5,210,472, overcomes the problems of high-voltage switching and emitter-to-grid shorts, which, in turn, ameliorates the problem of display power consumption. The new architecture (hereinafter referred to as the "low-voltage-switching field emission display architecture") permits the switching of a high pixel activation voltage with low signal voltages that are compatible with standard CMOS, NMOS, or other integrated circuit logic levels. Instead of having row and columns tied directly to the cathode array, they are used to gate at least one pair of series-connected field effect transistors (FETs), each pair when conductive coupling the base electrode of a single emitter node to a potential that is sufficiently low, with respect to a higher potential applied to the grid, to induce field emission. Each row-column intersection (i.e. pixel) within the display may contain multiple emitter nodes in order to improve manufacturing yield and product reliability. In a preferred embodiment, the grid of the array is held at a constant potential ($V_{FE}$), which is consistent with reliable field emission when the emitters are at ground potential. A multiplicity of emitter nodes are employed, one or more of which correspond to a single pixel (i.e., row and column intersection). Each emitter node has its own base electrode, which is groundable through its own pair of series-coupled field-effect transistors by applying a signal voltage to both the row and column lines associated with that emitter node. One of the series-connected FETs is gated by a signal on the row line; the other FET is gated by a signal on the column line. Also in the preferred embodiment of the invention, each emitter node contains multiple cathode emitters. Hence, each row-column intersection controls multiple pairs of series-coupled FETs, and each pair controls a single emitter node (pixel) containing multiple emitters.

The regulation of cathode-to-grid current has become a major issue in the design of field emission displays, as the issues of cathode life expectancy, low power consumption, and stability requirements are addressed.

The issue of current regulation has been addressed with respect to conventionally constructed flat panel field emission displays, such as the one depicted in FIG. 1. For example, in U.S. Pat. No. 4,940,916, Michel Borel and three colleagues disclose a field emission display having a resistive layer between each cathode (emitter tip) and an underlying conductive layer. In a subsequent U.S. Pat. No. 5,162,704, Yoichi Bobori and Mitsuru Tanaka disclose a field emission display having a diode in series with each emitter tip.

In U.S. patent application Ser. No. 08/011,927, which has become U.S. Pat. No. 5,357,172, a method is disclosed for reducing power consumption and enhancing reliability and stability in the low-voltage switching field emission display architecture by regulating cathode emission current. This is achieved by placing a resistor in series with each pair of series-coupled low-voltage switching MOSFETs. As heretofore explained, each MOSFET pair couples an emitter node, which contains one or more field emitter tips, to ground. The resistor is coupled directly to the ground bus and to the source of the MOSFET furthest from the emitter node. By coupling the current-regulating resistor directly to the ground bus, stable current values independent of cathode voltage are achieved over a wide range of cathode voltages.

Prototypes of the low-voltage switching field emission display architecture which incorporate the current-regulating resistors in the emitter grounding circuits have been constructed by Micron Display Technology, Inc., a subsidiary of Micron Technology, Inc. of Boise, Id. FIG. 2 is representative of such a prototype display. In the display of FIG. 2, a single emitter node is characterized by a conductive grid (also referred to as a first pixel element) 21, which is continuous throughout the entire array, and which is maintained at a constant potential, $V_{GRID}$. Each pixel element within the array is illuminated by an emitter group (not shown). In order to enhance product reliability and manufacturing yield, each emitter group comprises multiple emitter nodes, and each node contains multiple field emission cathodes. Although the single emitter node depicted by FIG. 2 has only three emitters (22A, 22B, and 22C), the actual number may be much higher. Each of the emitters 22 is connected to a base electrode 23 that is common to only the emitters of a single emitter node. In order to induce field emission, base electrode 23 is grounded through a pair of series-coupled field-effect transistors $Q_C$ and $Q_R$ and current-regulating resistor R. Resistor R is interposed between the source of transistor $Q_R$ and ground. Transistor $Q_C$ is gated by a column line signal $S_C$, while transistor $Q_R$ is gated by a row line signal $S_R$. Standard logic signal voltages for CMOS, NMOS, TTL and other integrated circuits are generally 5 volts or less, and may be used for both column and row line signals. A pixel is turned off (i.e., placed in a non-emitting state) by turning off either or both of the series-connected FETs ($Q_C$ and $Q_R$). From the moment that at least one of the FETs becomes non-conductive (i.e., the gate voltage $V_{GS}$ drops below the device threshold voltage $V_T$, electrons will continue to be discharged from the emitter tips corresponding to that pixel until the voltage differential between the base and the grid is just below emission threshold voltage. In order to improve yield and to minimize array power consumption, a fusible link FL is placed in series with the pull-down current path from base electrode 23 to ground via transistors $Q_C$ and $Q_R$. Fusible link FL may be blown during testing if a base-to-emitter short exists within that emitter group, thus isolating the shorted group from the rest of the array.

Although performance of the prototype displays has, in many respects, exceeded expectations, it has been noted that, under certain operating conditions, unintended pixel emission will continue even when the transistor nearest the emitter tip is turned "on" and the transistor nearest ground is turned "off". This problem is believed to be associated with the parasitic capacitance of the node between each pair of transistors in the pixel grounding path (hereinafter the intermediate node). The following sequence of events is the most likely cause of the phenomenon. The transistor nearest the emitter node is turned "off" by a low logic signal on its gate. Then, the transistor nearest ground is turned "off" by a low logic signal on its gate, resulting in the intermediate node being at ground potential. When the transistor nearest the emitter is then turned "on" by a high logic signal on its gate, the difference in potential between the emitter node and the grid is sufficient to cause field emission until the intermediate node has emitted a number of electrons sufficient to cause the difference in potential between the emitter node and the grid to drop below the emission threshold.

SUMMARY OF THE INVENTION

This invention is directed to a modification of the low-voltage switching field emission display architecture which solves the problem of unwanted emission when the grounding path is open. Instead of using a pair of series-coupled transistors in the emitter node grounding path (one of which is gated by a column signal and the other of which is gated by a row signal), only a single transistor is utilized in the emitter node grounding path, thus eliminating the intermediate node that was responsible for the unwanted emissions.

In all embodiments of the improved emitter node grounding circuit, the emitter node grounding path comprises a single primary grounding field-effect transistor that couples the emitter node to ground. In a preferred embodiment of the invention, a current regulating resistor is placed in the grounding path in series with the primary grounding transistor, with the resistor being directly coupled to ground. Additionally, for the preferred embodiment of the invention, the gate of the grounding transistor is coupled via a second field-effect transistor to either a row signal or a column signal. In the case where the gate of the first transistor is coupled to a row signal, the gate of the second transistor is coupled to a column signal. Likewise, where the gate of the first transistor is coupled to a column signal, the gate of the second transistor is coupled to a row signal. Numerous other equivalent circuits are possible, and several examples of such equivalent circuits are depicted in this disclosure.

PREFERRED EMBODIMENT OF THE INVENTION

Figure 1:
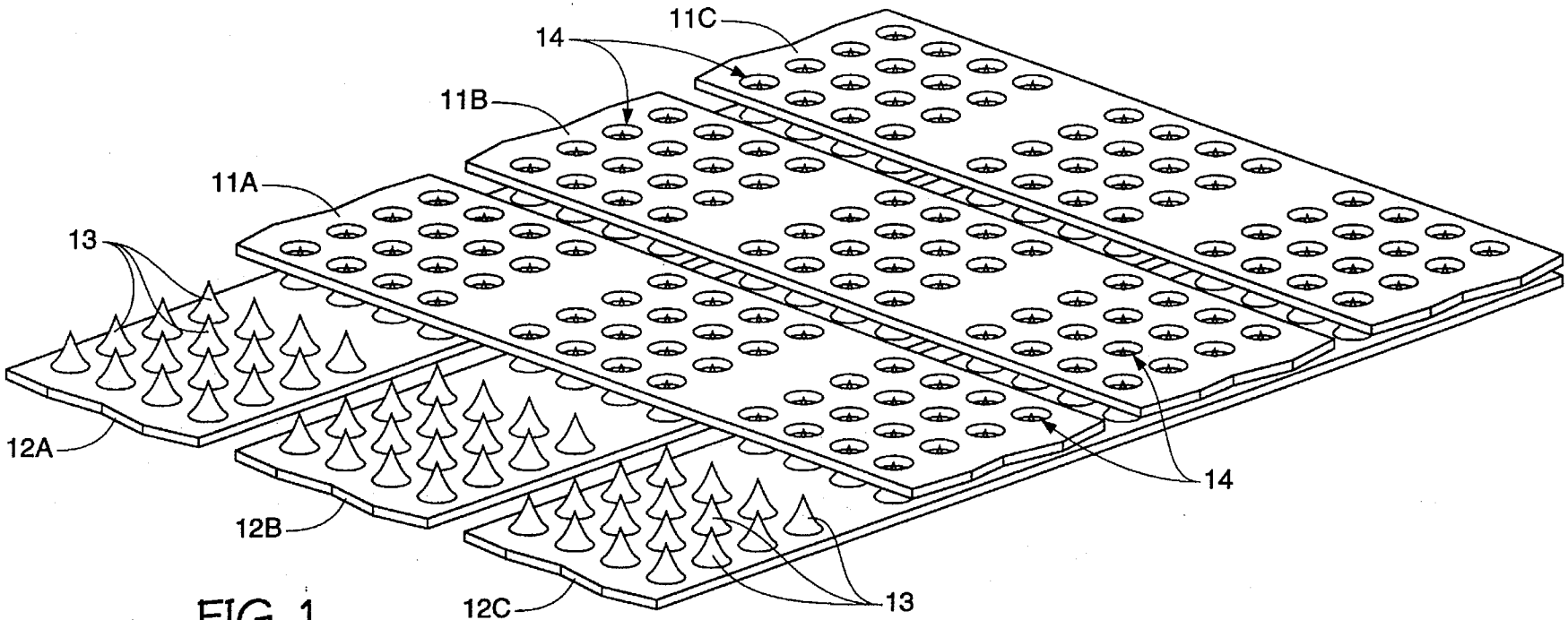
FIG. 1 (PRIOR ART)
FIG. 1 is a simplified perspective view of the grid and emitter base electrode structure in a contemporary conventional flat-panel field-emission display.
Figure 2:
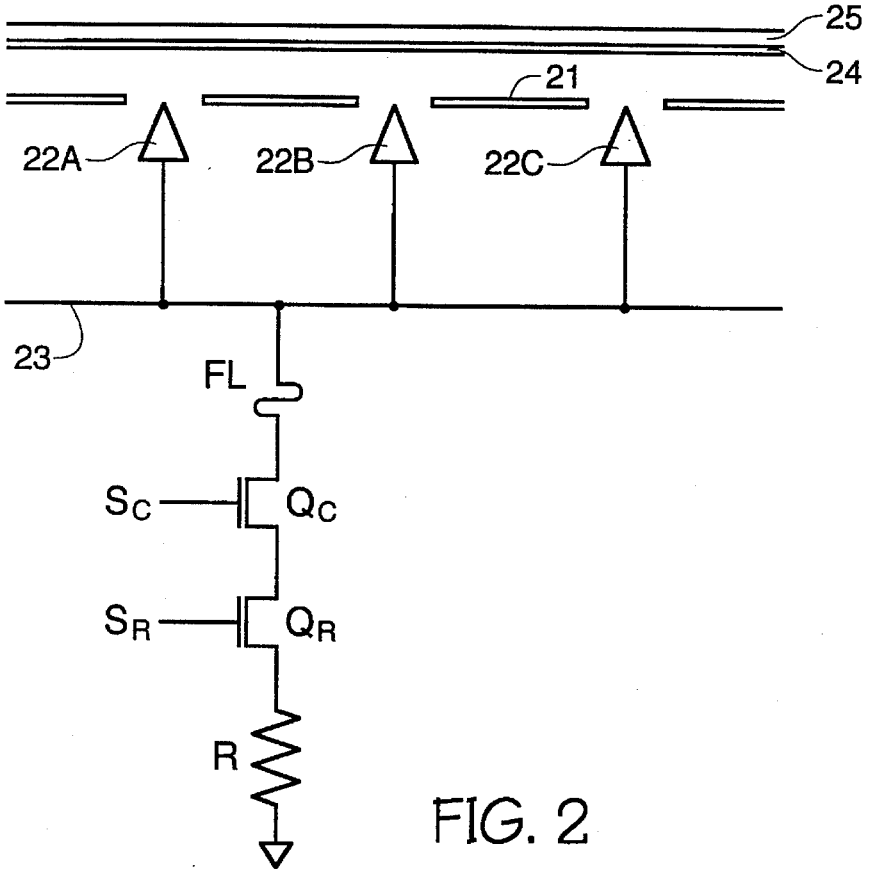
FIG. 2 is a schematic diagram of a single emitter node within the original low-voltage switching field emission display architecture that incorporates a current regulating resistor.
Figure 3:
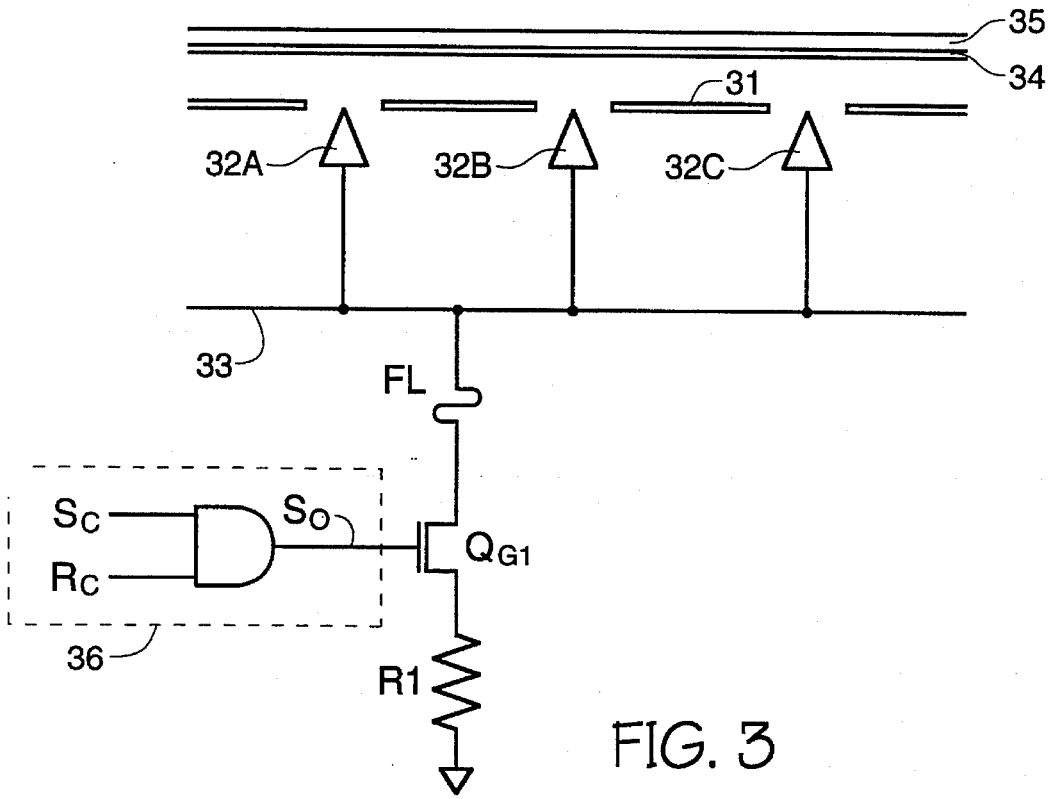
FIG. 3 is a schematic diagram of a single emitter node within the improved low-voltage switching field emission display architecture.

Referring now to FIG. 3, a single emitter node within the improved low-voltage switching field-emission display architecture is characterized by a conductive grid 31, which is continuous throughout the entire array, and which is maintained at a constant potential, $V_{GRID}$. In order to enhance product reliability and manufacturing yield, multiple emitter nodes are grouped for individual pixels within the display, and each node contains multiple field emission cathodes 32A, 32B, and 32C (also referred to as "field emitters" or "emitters"). Although the single emitter node depicted by FIG. 3 has only three emitters (32A, 32B, and 32C), the actual number may be much higher. Each of the emitters 32 is connected to a base electrode 33 that is common to only the emitters of a single emitter node, and which is insulated from the grid 31. In order to induce field emission, base electrode 33 is grounded through a single, primary grounding field-effect transistor $Q_{G1}$ and a current-regulating resistor R1. Resistor R1 is interposed between the source of transistor $Q_{G1}$ and ground. Pixel illumination occurs, when electrons emitted from the emitter tips strike a phosphor coating 34 on screen 35.

Still referring to FIG. 3, a fusible link FL is placed in series with the pull-down current path from base electrode 33 to ground via transistors $Q_{G1}$ and resistor R1. Fusible link FL may be blown during testing if a base-to-emitter short exists within that emitter group, thus isolating the shorted group from the rest of the array in order to improve yield and to minimize array power consumption. It should be noted that the position of fusible link FL within the grounding path is inconsequential (i.e., it may be located between the base electrode 33 and the grounding transistor $Q_{G1}$, as actually shown in FIG. 3, between ground and resistor R1, or between resistor R1 and the grounding transistor $Q_{G1}$).

Figure 4:
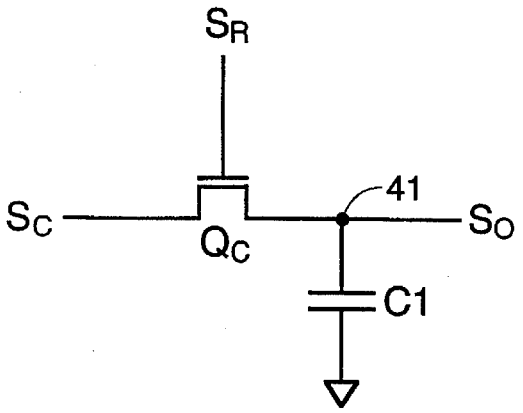
FIG. 4 is a schematic diagram of a preferred embodiment circuit used to gate the grounding transistor.

Still referring to FIG. 3, for all embodiments of the improved low-voltage switching field-emission display architecture, transistor $Q_{G1}$ is gated by an output signal $S_O$, which is the product of a logic function having, as inputs, the signal on a column line signal $S_C$ and the signal on a row line signal $S_R$. The logic function, which is represented by block 36, can be generated in a variety of ways. FIG. 4 depicts the circuitry that the inventor deems to be the preferred means of generating the logic function. Other circuits, possessing various degrees of equivalency, are depicted in drawings FIGS. 5 through 8. Standard logic signal voltages for CMOS, NMOS, TTL and other integrated circuits are generally 5 volts or less, and may be used for both column and row line signals. An emitter node is turned off (i.e., placed in a non-emitting state) by cutting current flow through grounding transistor $Q_{G1}$ and resistor R1. From the moment that transistor $Q_{G1}$ becomes non-conductive (i.e., the gate voltage $V_{GS}$ drops below the device threshold voltage $V_T$, electrons will continue to be discharged from the emitter tips corresponding to that pixel until the voltage differential between the base and the grid is just below emission threshold voltage.

With further reference to FIG. 3, gray scaling (i.e., variations in pixel illumination) for the improved low-voltage switching field-emission display architecture is accomplished by varying the duty cycle (i.e. the period that the emitters within a pixel are actually emitting as a percentage of frame time). Brightness control is accomplished by varying the emitter current by varying the gate voltage on transistor $Q_{G1}$. Although duty cycle may be varied with equal ease for all embodiments of the logic function disclosed herein, certain embodiments lend themselves more easily to emitter current control.

Referring now to FIG. 4, which is the first and preferred embodiment of the logic function 36 generally depicted in FIG. 3, output signal $S_O$ is generated by coupling a column address signal line $S_C$ to the gate of grounding transistor $Q_{G1}$ through a control transistor $Q_C$. The gate of control transistor $Q_C$ is coupled to a row address signal line $S_R$. An identical result is obtained by coupling the row address signal line $S_R$ to the gate of transistor $Q_G$ through control transistor $Q_C$ and coupling the column address signal line $S_C$ to the gate of transistor $Q_C$. In either case, the circuit operates as an AND gate. An optional capacitor C1 is coupled between ground and node 41, which is common to the gate of grounding transistor $Q_{G1}$ and the source of control transistor $Q_C$. This added capacitance ensures that the emitter will remain on during a complete scan cycle. The capacitor C1 is discharged to the voltage level on the drain 43 of control transistor $Q_C$ when control transistor $Q_C$ is on. As a practical matter, the gate of grounding transistor $Q_{G1}$ has a certain amount of parasitic capacitance. Thus, a discrete capacitor, such as capacitor C1, may not be essential for circuit functionality. In addition, the decay properties of the phosphor on the screen of the display are also capable of maintaining pixel illumination between scans. This embodiment of the logic function of $S_R$ and $S_C$ is particularly advantageous, as the row and column signals do not control an independent high logic voltage that would other wise require routing to each pixel. This embodiment also lends itself well to both duty cycle control and emitter current control. Duty cycle control may be implemented by either pulsing the signal that is coupled to the gate of grounding transistor $Q_{G1}$, or pulsing the signal that is coupled to the gate of control transistor $Q_C$. Emitter current may be varied by either varying the gate voltage on transistor $Q_{G1}$, or the gate voltage on transistor $Q_C$.

Figure 5:
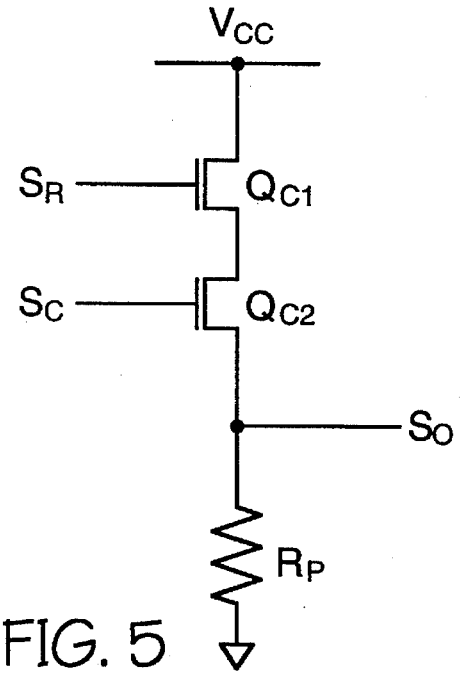
FIG. 5 is a schematic diagram of a second embodiment circuit used to gate the grounding transistor.

Referring now to FIG. 5, which is the second embodiment of the logic function 36 generally depicted in FIG. 3, output signal $S_O$ is generated by coupling a high logic level voltage $V_{CC}$ to the gate of grounding transistor $Q_{G1}$ through a pair of series connected field-effect control transistors $Q_{C1}$ and $Q_{C1}$, one of which is controlled by a column address signal $S_C$, and the other of which is controlled by a row address signal $S_R$. A pull-down resistor $R_P$ is required in order to pull down the voltage on the gate of grounding transistor $Q_{G1}$ during periods of pixel inactivity (i.e., during scans when at least one either the column address signal $S_C$ or the row address signal $S_R$ is low. This embodiment of the logical AND function has several disadvantages. Firstly, there is power dissipation through pull-down resistor $R_P$ whenever transistor $Q_G$ is conductive. For portable equipment, this may be a significant drawback. Secondly, the high logic voltage $V_{CC}$ must be routed to every pixel within the display, greatly complicating the layout as compared with the embodiment of FIG. 4. In this embodiment of the logical AND function, duty cycle control may be implemented by pulsing either of the signals $S_R$ or $S_C$, and emitter current may be varied by varying the gate voltage on either transistor $Q_{C1}$ or $Q_{C2}$.

Figure 6:
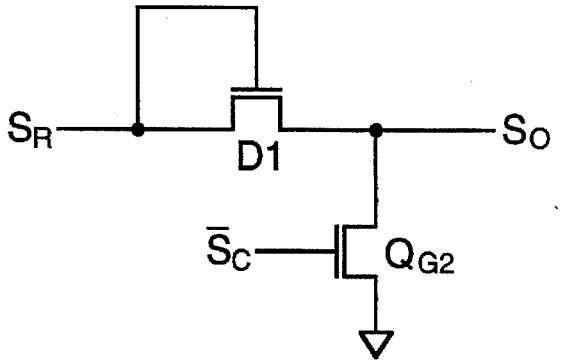
FIG. 6 is a schematic diagram of a third embodiment circuit used to gate the grounding transistor.

Referring now to FIG. 6, which is the second embodiment of the logic function 36 generally depicted in FIG. 3, output signal $S_O$ is generated by coupling one of either a row address signal or a column address signal to the gate of grounding transistor $Q_{G1}$ (see FIG. 3) through a diode D1 which is on when the signal is high. The gate of grounding transistor $Q_{G1}$ is also coupled to ground through a secondary grounding transistor $Q_{G2}$. The secondary grounding transistor $Q_{G2}$ is controlled by the complement of the address signal not coupled to the gate of ground transistor $Q_G$. That is, if (as shown in FIG. 6) the row address signal $S_R$ is coupled to the gate of transistor $Q_{G1}$, then the complement of the column address signal $S_C$ is coupled to the gate of transistor $Q_{G2}$, and visa versa. This embodiment of the logical AND function has the disadvantage that power is dissipated through transistor $Q_{G2}$ whenever diode D1 is conducting and the column signal $S_C$* is active (i.e., whenever the pixel group controlled by transistor $Q_{G1}$ is selected).

Although only several embodiments of the invention have been disclosed in detail herein, it will be obvious to those having ordinary skill in the art that changes and modifications may be made thereto without departing from the scope and spirit of the invention as claimed. For example, although the logic function 36 of FIG. 3 is represented as an AND gate, other equivalent logical operations (e.g., NAND, OR, XOR, NOR operations) could be used if the signals $S_R$ and $S_C$ are inverted. While the particular embodiments herein depicted and described are fully capable of attaining the objectives and providing the advantages hereinbefore stated, it is to be understood that this disclosure is meant to be merely illustrative of the presently-preferred embodiment and certain other less-preferred embodiments of the invention, and that no limitations are intended with regard to the details of construction or design thereof beyond the limitations imposed by the appended claims.

We claim:

1. An improved field emission display comprising:

multiple row address lines;

multiple column address lines;

said row address lines intersecting said column address lines, with the intersection of a single row address line with a single line being associated with a single pixel within said display;

a grid which is common to the entire display, and which is held at a first potential;

a plurality of pixels, wherein each pixel includes a group of field emission cathodes, wherein connecting the cathodes to a potential sufficiently low relative to said first potential will induce field emission;

a logical AND gate circuit having an output and first and second inputs for receiving first and second input signals, respectively, one of said inputs being coupled to that pixel's respective row address line, and the other input being coupled to that pixel's column address line, wherein the logical AND gate circuit produces at its output a signal which is a logical AND of the first and second input signals;

a first transistor having gate, drain, and source terminals, the gate being connected to the output of the gate circuit, and the drain being connected to the field emission cathodes in said group; and a resistance connected between a second potential and the source terminal of the first transistor, the second potential being less than said potential sufficient to induce field emission;

wherein said logical AND gate circuit comprises a high logic voltage coupled to the gate of said first transistor through a pair of series-coupled field effect control transistors, one of which is gated by the column address signal line associated with that particular pixel, and the other of which is gated by the row address signal line associated with that particular pixel.

2. An improved field emission display comprising:

multiple row address lines;

multiple column address lines;

said row address lines intersecting said column address lines, with the intersection of a single row address line with a single column address line being associated with a single pixel within said display;

a grid which is common to the entire display, and which is held at a first potential;

a plurality of pixels, wherein each pixel includes a group of field emission cathodes, wherein connecting the cathodes to a potential sufficiently low relative to said first potential will induce field emission;

a logical AND gate circuit having an output and first and second inputs for receiving first and second input signals respectively, one of said inputs being coupled to that pixel's respective row address line, and the other input being coupled to that pixel's column address line, wherein the logical AND gate circuit produces at its output a signal which is a logical AND of the first and second input signals;

a first transistor having gate, drain, and source terminals, the gate being connected to the output of the gate circuit, and the drain being connected to the field emission cathodes in said group; and a resistance connected between a second potential and the source terminal of the first transistor, the second potential being less than said potential sufficient to induce field emission;

wherein said logical AND gate circuit comprises one of either the column address line or the row address line associated with that particular pixel coupled to the gate of said first transistor through a diode, the gate of said first transistor also being coupled to said second potential through a control transistor, and the gate of said control transistor being coupled through an inverter to the other address signal line associated with that particular pixel.

3. A method of varying the current through a number of field emitters in a field emission display, thereby controlling the brightness of the light emitted by the display in response to said field emitters, comprising the steps of:

providing a field emission display having a grid connected to a first voltage and having a number of field emitters, wherein connecting the field emitters to a voltage whose value is sufficiently low relative to the first voltage will induce emission current through the field emitters;

providing a first transistor having gate, source, and drain terminals;

connecting the drain of the first transistor to the field emitters;

connecting a resistance between the source of the first transistor and a second voltage less than said sufficiently low voltage value;

applying a third voltage to the gate of the first transistor; and varying the third voltage, whereby the current through the field emitters varies in response to the third voltage.

4. A method according to claim 3, further comprising the steps of:

providing a second transistor having gate, source, and drain terminals;

connecting the drain of the second transistor to the gate of the first transistor;

applying a first input signal voltage to the gate of the second transistor;

applying a second input signal voltage to the source of the second transistor; and varying the second input signal voltage, whereby the current through the field emitters varies in response to the second input signal voltage.

5. An improved field emission display comprising:

multiple row address lines;

multiple column address lines;

said row address lines intersecting said column address lines, with the intersection of a single row address line with a single column address line being associated with a single pixel within said display;

a grid which is common to the entire display, and which is held at a first potential;

a plurality of pixels, wherein each pixel includes a group of field emission cathodes, wherein connecting the cathodes to a potential sufficiently low relative to said first potential will induce field emission;

a logical AND gate circuit having an output and first and second inputs for receiving first and second input signals, respectively, one of said inputs being coupled to that pixel's respective row address line, and the other input being coupled to that pixel's column address line, wherein the logical AND gate circuit produces at its output a signal which is a logical AND of the first and second input signals;

a first transistor having gate, drain, and source terminals, the gate being connected to the output of the gate circuit, and the drain being connected to the field emission cathodes in said group; and a resistance connected between a second potential and the source terminal of the first transistor, the second potential being less than said potential sufficient to induce field emission;

wherein said logical AND gate circuit comprises one of either the column address line or the row address line associated with that particular pixel coupled to the gate of said first transistor through a diode, the gate of said first transistor also being coupled to said second potential through a control transistor, and the gate of said control transistor being coupled to the other address line associated with that particular pixel, said other address line providing an address signal which is logically inverted.

* * * * *